US011230749B2

(12) United States Patent
Daube et al.

(10) Patent No.: US 11,230,749 B2
(45) Date of Patent: Jan. 25, 2022

(54) METHOD FOR OPERATING AN ANNEALING FURNACE

(71) Applicant: SMS group GmbH, Düsseldorf (DE)

(72) Inventors: Thomas Daube, Duisburg (DE); Markus Jaenecke, Solingen (DE); Lutz Kümmel, Jüchen (DE); Ulrich Sommers, Düsseldorf (DE); Alexandre Lhoest, Eupen (BE)

(73) Assignee: SMS group GmbH, Düsseldorf (DE)

( * ) Notice: Subject to any disclaimer, the term of this patent is extended or adjusted under 35 U.S.C. 154(b) by 229 days.

(21) Appl. No.: 16/624,582

(22) PCT Filed: Jun. 5, 2018

(86) PCT No.: PCT/EP2018/064722
§ 371 (c)(1),
(2) Date: Dec. 19, 2019

(87) PCT Pub. No.: WO2018/234028
PCT Pub. Date: Dec. 27, 2018

(65) Prior Publication Data

US 2020/0131599 A1 Apr. 30, 2020

(30) Foreign Application Priority Data

Jun. 20, 2017 (DE) ..... 10 2017 210 230.6

(51) Int. Cl.
*C21D 11/00* (2006.01)
*F27D 21/00* (2006.01)
(Continued)

(52) U.S. Cl.
CPC ..... *C21D 11/00* (2013.01); *B21B 37/74* (2013.01); *C21D 9/561* (2013.01); *C21D 9/562* (2013.01);
(Continued)

(58) Field of Classification Search
CPC ..... C21D 11/00; C21D 9/561; C21D 9/562; B21B 37/74; B21B 2037/002;
(Continued)

(56) References Cited

U.S. PATENT DOCUMENTS 5,673,368 A 9/1997 Broese et al.
2014/0175713 A1 6/2014 Roessiger et al.
(Continued)

FOREIGN PATENT DOCUMENTS

CN 102876880 A 1/2013
CN 103732766 A 4/2014
(Continued)

OTHER PUBLICATIONS

Smith M A et al, "Application of Distributed Control On UPI's KM/CAL", AISE Steel Technology, AISE, Pittsburg, PA, US,vol. 70, No. 6, Jun. 1, 1993 (Jun. 1, 1993), p. 17-22,XP000387767.
(Continued)

*Primary Examiner* — Scott R Kastler
(74) *Attorney, Agent, or Firm* — Smartpat PLC

(57) ABSTRACT

A method for operating an annealing furnace to anneal a metal strip provides that, initially, at least one target material property ($MP_{Target}$) is specified for a point or a section of the metal strip after passing through the annealing furnace. In addition, information (E) on the metal strip is provided before or in the annealing furnace. A calculation of a target temperature distribution ($T_{Target}$) and/or a target speed ($V_{Target}$) of the metal strip in the annealing furnace is then carried out with the assistance of a computer-aided model as a function of the target material properties and the specified information. The target temperature distribution and/or target speed calculated in this manner is/are subsequently set in the annealing furnace in order to transfer the material
(Continued)

property of the metal strip behind the annealing furnace to the desired target material property $MP_{Target}$.

7 Claims, 2 Drawing Sheets

(51) Int. Cl.
*B21B 37/00* (2006.01)
*B21B 37/74* (2006.01)
*C21D 9/56* (2006.01)
*F27D 19/00* (2006.01)

(52) U.S. Cl.
CPC .... *F27D 21/0014* (2013.01); *B21B 2037/002* (2013.01); *B21B 2261/20* (2013.01); *F27D 2019/0003* (2013.01); *F27D 2019/0059* (2013.01)

(58) Field of Classification Search
CPC ..... B21B 2261/20; F27D 21/0014; F27D 2019/0003; F27D 2019/0059
See application file for complete search history.

(56) References Cited

U.S. PATENT DOCUMENTS

2016/0102916 A1 4/2016 Hartung et al.
2016/0377345 A1* 12/2016 Custers ..... F27D 11/06 148/511
2020/0131599 A1* 4/2020 Daube ..... C21D 9/56
2020/0232706 A1 7/2020 Custers et al.

FOREIGN PATENT DOCUMENTS

CN 106119521 A 11/2016
DE 102013225579 A1 11/2014
EP 2742158 B1 8/2015
JP 2013100578 A 5/2013
JP 2015059226 A 3/2015
WO 2016210084 A1 12/2016

OTHER PUBLICATIONS

Vallee G et al, "Ligne De Recuit Tout Asynchrone Pour Ugine Gueugnon", Revue De Metallurgie—Cahiers D'Informations Techniques, Revue De Metallurgie. Paris, FR,vol. 90, No. 6, Jun. 1, 1993 (Jun. 1, 1993), p. 843-847, XP000393745.
Yahiro K et al, "Development of Strip Temperature Control System for a Continuous Annealing Line", Plenary Session, Emerging Technologies, and Factory Automation. Maui, Nov. 15-19, 1993; [Proceedings of the International Conference on Industrial Electronics, Control, and Instrumentation (IECON)], New York, IEEE, US,vol. 1, Nov. 15, 1993 (Nov. 15, 1993), p. 481-486,XP000451844.

* cited by examiner

METHOD FOR OPERATING AN ANNEALING FURNACE

TECHNICAL FIELD

The disclosure relates to a method for operating an annealing furnace to anneal a metal strip.

BACKGROUND

Methods for operating an annealing furnace are generally known in the prior art, for example from the German application document DE 10 2013 225 579 A1. This document discloses a method for controlling and/or regulating an annealing or heat treatment furnace for a metal strip, wherein the furnace is upstream of a roll stand. At least one measuring device makes online recordings of a mechanical material property of the metal strip and generates a corresponding measured value. Such measured value is fed back into the regulator for the annealing or heat treatment furnace.

EP 2 742 158 B1 discloses a method for operating a continuous annealing line for processing a metal strip. A model predictive regulation is proposed, with which at least one property of the metal strip is fed to a computer-aided model as an input variable, and wherein the input variable refers to a point or section of the metal strip before or in the continuous annealing line. With the assistance of the computer-aided model, at least one material property of the rolled material is simulated according to the continuous annealing process. This simulated material property is compared with a predefined target value. If the simulated material property deviates from the target value, at least one process variable, for example the temperature or the speed of the metal strip during the continuous annealing process, is controlled by a control device. This takes place until at least one point or section of the rolled material to which the input variable refers is still in front of or in the continuous annealing line.

The regulation of the material property of a metal strip to a desired target material property claimed in EP patent EP 2 742 158 B1, including a simulation of actual material properties of a metal strip with the assistance of a computer-aided model, requires a lot of computing power and calculation time. The regulation is carried out by an interactive modification of process parameters, temperature and/or speed in such a manner that the desired material properties for the metal strip result from it. The increased calculation time is disadvantageous, because it results in a reduction of the possible calculation cases or iteration steps.

SUMMARY

The disclosure is based on the task of further developing a known method for operating an annealing furnace to anneal a metal strip with a view to improving product quality and increasing yield. This task is solved by the claimed method.

The method constitutes a control (open-loop control), but not a regulation (closed-loop control). Within the framework of this control, the calculation and specification of a target temperature distribution and/or a target speed of the metal strip in the annealing furnace is carried out in such a manner that the metal strip has a desired target material property after leaving the annealing furnace. The presence of this desired target material property is not monitored within the framework of the method—unlike in the case of a regulation; in particular, the desired target material property is not compared with a measured actual material property of the metal strip downstream of the annealing output in order to form a material property control difference, and this control difference is not regulated to zero.

Strictly speaking, the term "temperature distribution" refers to a section of the metal strip. However, for the purposes of this description, the term "temperature distribution" also implies a singular temperature value at a particular point on the metal strip.

Within the meaning of this description, the term "annealing furnace" includes not only heating equipment but also cooling equipment downstream in the direction of flow.

The calculation and specification of a target temperature distribution and/or a target speed of the metal strip in the annealing furnace is less time-consuming than the simulation of material properties. In addition, there is no feedback of a process variable within the framework of the control system claimed. As a whole, an increase in output is thus possible.

The method can execute a desired self-correction or self-adaptation. For this purpose, the actual material property of the metal strip is measured after passing through the annealing furnace, and a comparative temperature distribution and/or a comparative speed of the metal strip in the annealing furnace are calculated with the assistance of the computer-aided model of the annealing furnace, as a function of the measured actual material property and provided information relating to the metal strip before or in the annealing furnace. The temperature distribution and/or the speed of the metal strip in the annealing furnace are then adjusted to the previously determined comparative temperature distribution and/or the comparative speed through the suitable adaptation of the computer-aided model.

In other words: within the framework of self-correction or self-adaptation, it is provided to carry out the method for the specification of a temperature distribution and/or the speed of the metal strip in the annealing furnace, with the only difference that the computer model is supplied with, instead of the target material property, the actually measured material property of the metal strip as an input variable after passing through the annealing furnace. For a better conceptual distinction in this case, the output variables of the computer-aided model are called comparative variables, here specifically the comparative temperature distribution and/or the comparative speed. The actual temperature distribution and/or the actual speed of the metal strip in the annealing furnace are recorded as actual values and compared with the previously calculated comparative variables. Such comparison may result in a nonzero deviation for the temperature distribution and/or for the speed of the metal strip in the annealing furnace. In an adaptation value calculation unit, at least one suitable adaptation value is then calculated on the basis of the specified deviations. The computer-aided model is then adapted with the assistance of the calculated adaptation value. The method described above for operating an annealing furnace is then carried out for future metal strips, preferably with the adapted computer-aided model. This results in optimized target temperature distributions and/or target speeds for the metal strip, which are set as control elements in the annealing furnace with the assistance of a furnace control system.

In one embodiment, the computer-aided model can work, for example, with an experience database or with a statistical model or with stored annealing curves, and can therefore be used for any steel grade. This model can be used immediately, especially for newly developed steel grades. In contrast to a physical model, which must first be implemented for each new steel grade, the statistical model used is easier to generate.

In accordance with another preferred exemplary embodiment, the adaptation of the computer-assisted model does not take place during the passing through the annealing surface of that metal strip on the basis of whose measured or simulated actual material properties the calculation of the at least one adaptation value or the adaptation of the computer-assisted model was carried out. Instead, the adaptation preferably takes place only for metal strips to be annealed in the future.

The term "material property of the metal strip," whether target or actual variable, within the framework of this description refers, for example, to the yield strength, tensile strength, elongation at break or uniform elongation of the metal strip after it has passed through the annealing furnace.

The term "information relating to the metal strip" includes, for example, its tensile strength and/or yield strength before a continuous galvanizing line (CGL), before a continuous annealing line (CAL), in a pickling line or before a reel. The information can also refer to

- the reel temperature,
- the final rolling temperature of the metal strip upon exiting a finishing train,
- the input temperature of the slab from which the metal strip is produced, at the input of a finishing roll train,
- the strip speed of the metal strip upon exiting the last stand—the finishing roll train,
- the rolling force in a skin pass mill,
- the rolling forces during cold rolling,
- the rolling forces during hot rolling,
- the input temperature of the slab in a roughing stand in front of the finishing roll train,
- the cold rolling grade,
- the composition of the material, in particular the steel of the metal strip, and in particular its carbon content and/or
- the straightening force at the flattener in front of the CGL/CAL.

This enumeration does not claim to be complete; rather, other or further information can be added to the computer-aided model as input variables.

DETAILED DESCRIPTION

Exemplary embodiments are described in detail below with reference to the specified figures. In all figures, the same technical elements are designated with the same reference signs.

Figure 1:
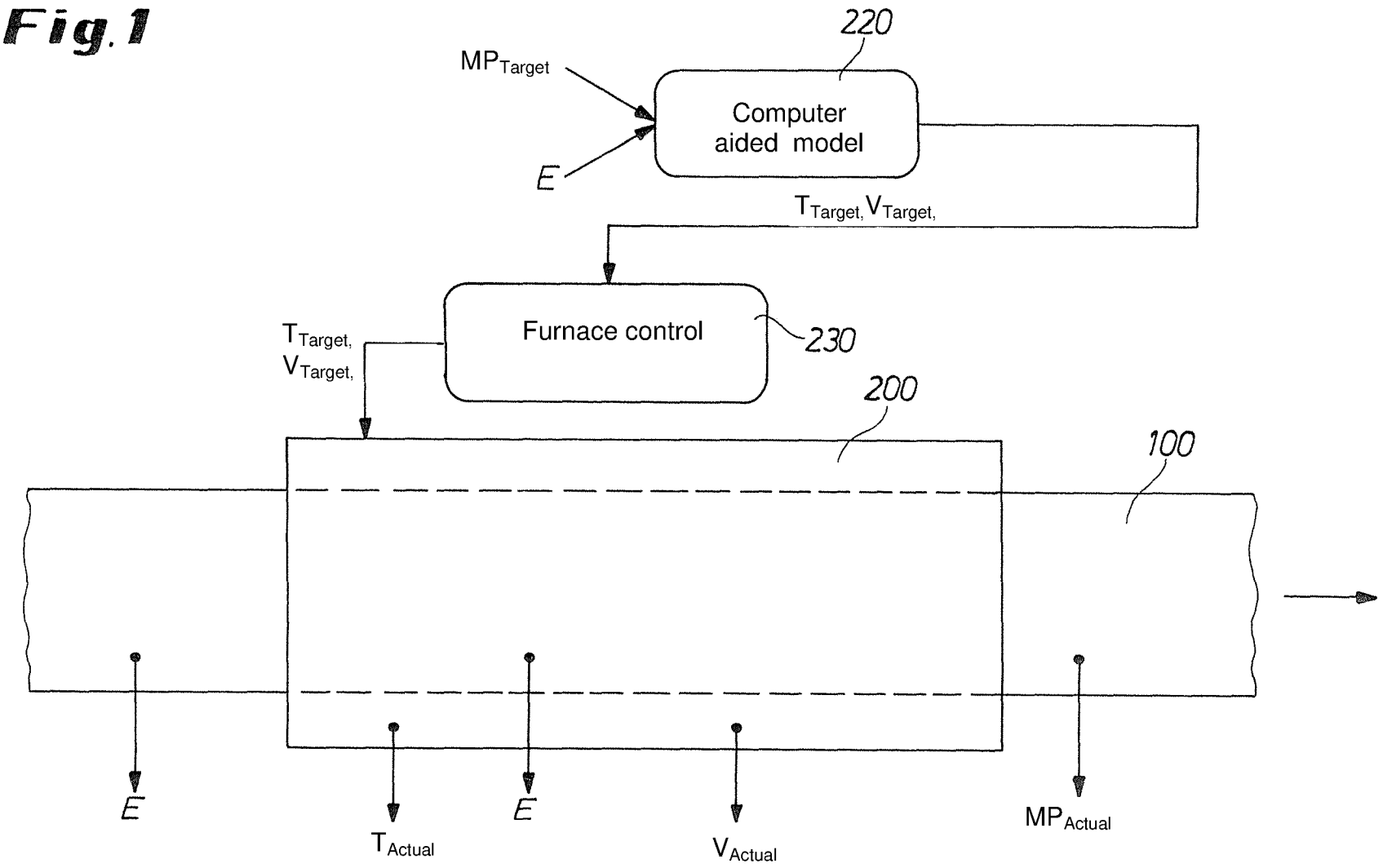
FIG. 1 illustrated a method for operating an annealing furnace.

FIG. 1 illustrates the method for operating an annealing furnace 200. In the annealing furnace 200, a metal strip 100 is annealed while passing through the annealing furnace in the direction of the arrow. The core element of the method is the calculation of a target temperature distribution $T_{Target}$ and/or a target speed $V_{Target}$ for the metal strip in the annealing furnace. This calculation is carried out with the assistance of a computer-aided model 220 of the annealing furnace as a function of a specified desired target material property $MP_{Target}$ of the metal strip and as a function of information E relating to the metal strip. The information relates to properties of the metal strip before or in the annealing furnace 200 or it relates to information on previous processing steps in the manufacture of the metal strip. With regard to a broader meaning of the terms "material property" and "information," reference is made at this point to the definitions of such terms given above in the general part of the description.

After the calculation of the target temperature distribution $T_{Target}$ and/or the target speed $V_{Target}$ by the computer-aided model 220, the corresponding values are output to a furnace control system 230 as control elements and implemented or set by this in the annealing furnace 200. The specified setting of the target temperature distribution $T_{Target}$ and/or the target speed $V_{Target}$ of the metal strip in the annealing furnace is carried out with the aim of transferring the actual material property $MP_{Actual}$ of the metal strip behind the annealing furnace to the specified desired target material property $MP_{Target}$, likewise behind the annealing furnace.

The calculation of the target temperature distribution $T_{Target}$ and/or the target speed $V_{Target}$ of the metal strip in the annealing furnace is carried out as long as at least one point or section of the metal strip to which the specified target material property $MP_{Target}$ of the metal strip refers is still in front of or in the annealing furnace.

The computer-aided model 220 can use an experience database, a statistical model and/or stored annealing curves when calculating the target temperature distribution $T_{Target}$ in the annealing furnace 200 and/or when calculating the target speed $V_{Target}$ with which the metal strip passes through the annealing furnace 200.

Figure 2:
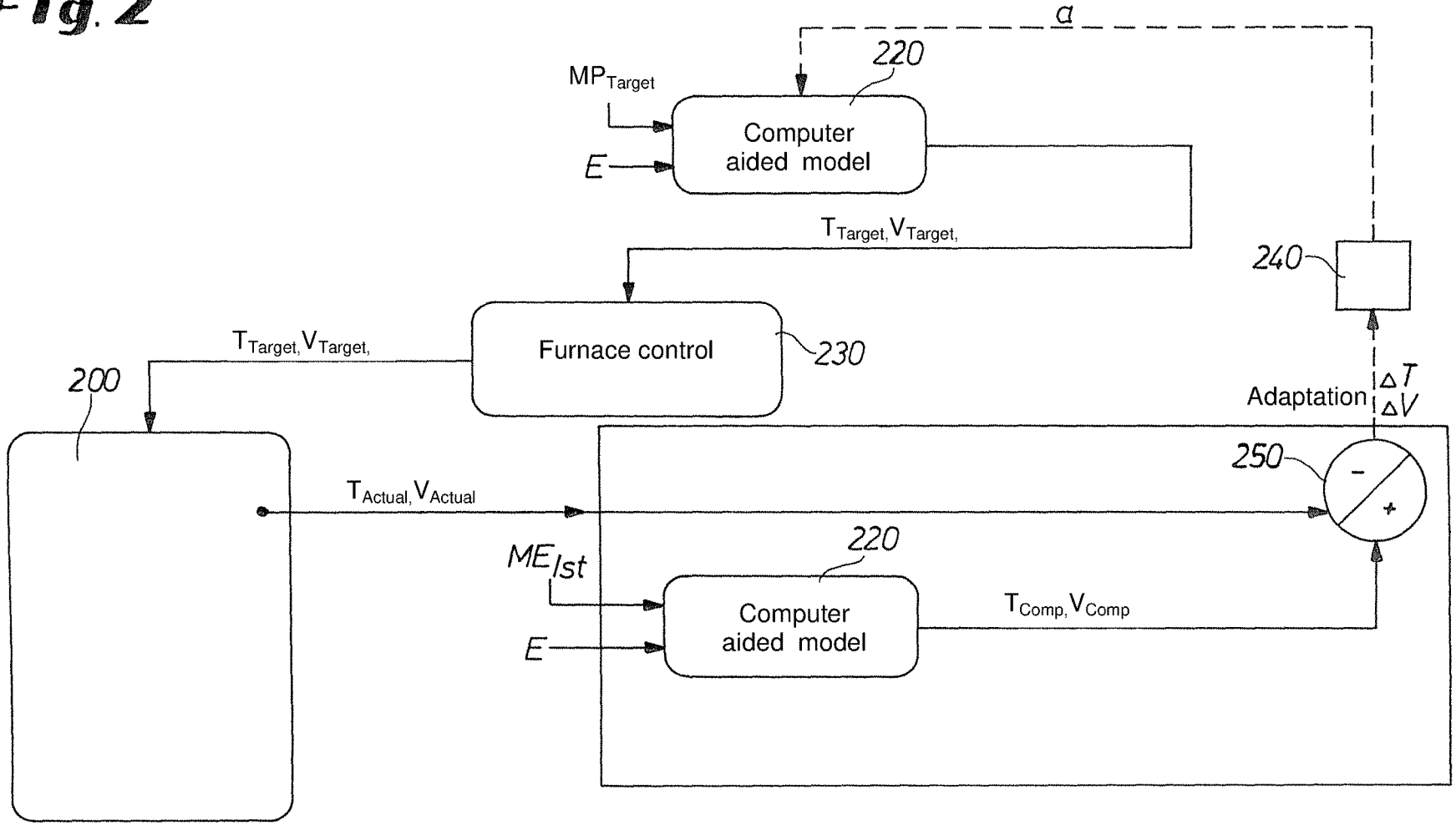
FIG. 2 illustrated the adapting of a computer-aided model.

In order to continuously improve the quality of the method for operating the annealing furnace 200, the method optionally provides for an occasional adaptation of the computer-aided model 220, see FIG. 2. For this adaptation, the method provides the following sub-steps:

- Measurement of the actual material property $MP_{Actual}$ of the metal strip 100 after passing through the annealing furnace 200, see FIG. 1. The measurement preferably takes place at the point or section of the metal strip for which the desired target material property has been specified.
- Calculation of a comparative temperature distribution $T_{Comp}$ and/or a comparative speed $V_{Comp}$ of the metal strip 100 in the annealing furnace with the assistance of the computer-aided model 220 as a function of the measured actual material property $MP_{Actual}$ of the metal strip 100 and as a function of the provided information E on the metal strip before or in the annealing furnace 200.

The comparative temperature distribution $T_{Comp}$ and comparative speed $V_{Comp}$ are calculated with the same computer model 220, taking into account the same information E on the metal strip as the first input variable, such as the target temperature distribution and the target speed of the metal strip in the annealing furnace as shown in FIG. 1. However, for the calculation of the comparative variables as the second input variable, the computer model 220 does not take into account the desired target material property $MP_{Target}$, but the actual material property $MP_{Actual}$ of the metal strip actually measured behind the annealing furnace. The temperature distribution and/or the speed of the metal strip in the annealing furnace are then adjusted to the calculated corresponding comparative variables, i.e. the comparative temperature distribution $T_{Comp}$ and/or the comparative speed $V_{Comp}$ through an appropriate adaptation of the computer-aided model 220.

Specifically, the specified adjustment comprises the following sub-steps; see FIG. 2:

The actual temperature distribution $T_{Actual}$ and/or actual speed $V_{Actual}$ of the metal strip 100 in the annealing furnace 200 is/are measured; see FIGS. 1 and 2. Such measured variables are compared in a comparison device 250 with the previously calculated associated comparative variables; i.e. a temperature deviation ΔT and/or a speed deviation ΔV are determined if necessary: $\Delta T=T_{Comp}\ T_{Actual}$, $\Delta V=V_{Comp}-V_{Actual}$.

At least one of these deviations is included in an adaptation value calculation device 240, which calculates from these input variables at least one suitable adaptation value a for adjusting or adapting the computer-aided model 220. The computer-aided model 220 is then adapted with such adaptation value. Such adaptation of the computer model 220 does not take place during the passing of a metal strip through the annealing furnace, but preferably only after the passing through of a complete metal strip. For this reason, the adaptation of the computer-aided model 220 will only have an effect on future metal strips. In this respect, the adjustment to the comparative value is extremely slow. Advantageously, the adaptation and the measured value acquisition carried out for it enables good documentation and thus also conclusive proof of the production conditions in the past; this is valuable quality documentation for further processors.

After the computer model 220 has been adapted, future calculations of the target temperature distribution $T_{Target}$ and/or the target speed $V_{Target}$ of the metal strip are performed with the assistance of the adapted computer-aided model. The annealing furnace 200 is then operated with the newly calculated target values for temperature distribution or speed distribution.

LIST OF REFERENCE SIGNS

100 Metal strip
200 Annealing furnace
220 Computer-aided model
230 Furnace control system as control element
240 Adaptation value calculation device
E Information relating to the metal strip
$MP_{Actual}$ Actual material property of the metal strip
$MP_{Target}$ Target material property of the metal strip
$T_{Actual}$ Actual temperature distribution of the metal strip in the annealing furnace
$T_{Target}$ Target temperature distribution of the metal strip in the annealing furnace
$T_{Comp}$ Comparative temperature distribution for the metal strip
$V_{Actual}$ Actual speed of the metal strip in the annealing furnace
$V_{Target}$ Target speed of the metal strip in the annealing furnace
$V_{Comp}$ Comparative speed for the metal strip in the annealing furnace
ΔT Temperature deviation
ΔV Speed deviation

The invention claimed is:

1. A method for operating an annealing furnace (200) for annealing a metal strip, comprising the following steps:

selecting a desired target material property ($MP_{Target}$), to be assumed by a point or section of the metal strip (100) after passing through the annealing furnace (200), the target material property ($MP_{Target}$) being one of a yield strength, a tensile strength, an elongation at break and a uniform elongation;

providing information (E) relating to the metal strip in front of or in the annealing furnace (200);

calculating a target temperature distribution ($T_{Target}$) and/or a target speed ($V_{Target}$) of the metal strip (100) in the annealing furnace (200) by a computer-aided model (220) as a function of the desired target material property ($MP_{Target}$) and the information (E) relating to the metal strip;

setting the target temperature distribution ($T_{Target}$) and/or the target speed ($V_{Target}$) of the metal strip (100) in the annealing furnace (200) by a furnace control system (230) as a control element;

measuring an actual material property ($MP_{Actual}$) of the metal strip (100) after passing through the annealing furnace (200);

calculating a comparative temperature distribution ($T_{Comp}$) and/or a comparative speed ($V_{Comp}$) of the metal strip (100) in the annealing furnace (200) with by the computer-aided model (220) as a function of the measured actual material property ($MP_{Actual}$) of the metal strip (100) after passing through the annealing furnace (200) and the information (E) relating to the metal strip in front of or in the annealing furnace (200); and adjusting the temperature distribution and/or the speed of the metal strip (100) in the annealing furnace (200) to the comparative temperature distribution ($T_{Comp}$) and/or the comparative speed ($V_{Comp}$) through adapting of the computer-aided model;

wherein the adapting of the computer-aided model takes place only after the passing of at least the entire metal strip through the annealing furnace (200), and wherein the adapting of the computer-aided model comprises the sub-steps of measuring an actual temperature distribution ($T_{Actual}$) and/or an actual speed ($V_{Actual}$) of the metal strip (100) in the annealing furnace (200), comparing the actual temperature distribution ($T_{Actual}$) with the calculated comparative temperature distribution ($T_{Comp}$) and determining a temperature deviation (ΔT); and/or comparing the actual speed ($V_{Actual}$) of the metal strip (100) in the annealing furnace (200) with the comparative speed ($V_{Comp}$) and determining a speed deviation (ΔV);

calculating at least one adaptation value (a) for adjustment of the computer-aided model (220) based on the temperature deviation (ΔT) and/or the speed deviation (ΔV);

adapting the computer-aided model (220) based on the adaptation value (a); and recalculating the target temperature distribution ($T_{Target}$) and/or the target speed ($V_{Target}$) of a new metal strip (100) by the adapted computer-aided model (220), and wherein the information (E) relating to the metal strip (100) before or in the annealing furnace (200) is selected from the group consisting of a tensile strength and/or a yield strength before a continuous galvanizing line (CGL), before a continuous annealing line (CAL), in a pickling line, or before a reel, a reel temperature, a final rolling temperature of the metal strip upon exiting a finishing roll train, an input temperature of a slab from which the metal strip is produced, at the input of the finishing roll train, a strip speed of the metal strip upon exiting a last stand of the finishing roll train, a rolling force in a skin pass mill, rolling forces during cold rolling, rolling forces during hot rolling, an input temperature of the slab into a roughing stand in front of the finishing roll train, a cold rolling grade, a composition of a material of the metal strip, a carbon content of the metal strip; and a straightening force at a flattener in front of the CGL/CAL.

2. The method according to claim 1, wherein measuring the actual material property ($MP_{Actual}$) of the metal strip (100) after passing through the annealing furnace (200) is performed at the point or section of the metal strip for which the desired target material property is specified.

3. The method according to claim 1, wherein the adaptation of the computer-aided model takes place only after the passing of a plurality of metal strips through the annealing furnace (200).

4. The method according to claim 1, wherein calculating the target temperature distribution and/or the target speed of the metal strip takes place as long as the at least one point or section of the metal strip to which the desired target material property ($MP_{Target}$) of the metal strip refers is still located before or in the annealing furnace (200).

5. The method according to claim 1, wherein the computer-aided model (220) uses an experience database, a statistical model, or stored annealing curves when calculating the target temperature distribution ($T_{Target}$) and/or the target speed ($V_{Target}$).

6. The method according to claim 1, wherein the actual material property of the metal strip is measured directly online or on a sample taken from the metal strip after the metal strip (100) has passed through the annealing furnace.

7. The method according to claim 1, further comprising repeating the steps according to claim 1 with the adapted computer-aided model when annealing a future metal strip (100).

* * * * *